US010186744B2

(12) United States Patent
Ramzan et al.

(10) Patent No.: US 10,186,744 B2
(45) Date of Patent: Jan. 22, 2019

(54) MICROSTRIP FANO RESONATOR SWITCH

(71) Applicant: UNITED ARAB EMIRATES UNIVERSITY, Al-Ain (AE)

(72) Inventors: Rashad Ramzan, Al-Ain (AE); Muhammad Amin, Madinah (SA); Omar Farooq Siddiqui, Madinah (SA); Nabil Bastaki, Al-Ain (AE)

(73) Assignee: United Arab Emirates University, Al-Ain (AE)

( * ) Notice: Subject to any disclaimer, the term of this patent is extended or adjusted under 35 U.S.C. 154(b) by 160 days.

(21) Appl. No.: 15/425,997

(22) Filed: Feb. 6, 2017

(65) Prior Publication Data

US 2018/0226706 A1 Aug. 9, 2018

(51) Int. Cl.

| | |
|---|---|
| ***H01P 1/203*** | (2006.01) |
| ***H01P 3/08*** | (2006.01) |
| ***H01P 7/08*** | (2006.01) |
| ***H01P 1/12*** | (2006.01) |

(52) U.S. Cl.

CPC ..... *H01P 1/203* (2013.01); *H01P 1/127* (2013.01); *H01P 3/08* (2013.01); *H01P 7/08* (2013.01); *H01P 7/082* (2013.01)

(58) Field of Classification Search

CPC .. H01P 1/203; H01P 3/08; H01P 3/081; H01P 3/084; H01P 3/087; H01P 7/08; H01P 7/082

USPC ..... 333/204, 205, 246, 258

See application file for complete search history.

(56) References Cited

U.S. PATENT DOCUMENTS

2010/0295701 A1 11/2010 Denis et al.
2012/0169436 A1* 7/2012 Nusair ..... H01P 1/2039 333/204

OTHER PUBLICATIONS

Mirzaei, "Negative-group-delay and non-foster electromagnetic structures,"—Thesis, University of Toronto, © 2015, Chapter 4, Fig. 4.4, p. 46.

* cited by examiner

*Primary Examiner* — Rakesh Patel
(74) *Attorney, Agent, or Firm* — Richman C. Litman

(57) ABSTRACT

The microstrip Fano resonator switch is a microstrip circuit having a varactor diode electrically connected between identical quarter-wavelength open stubs formed from two elongate planar strip elements disposed on a substrate having a permittivity of approximately 2.94 and a thickness of approximately 0.76 mm, the circuit forming a Fano resonator switch that provides approximately 50 dB of isolation.

13 Claims, 3 Drawing Sheets

MICROSTRIP FANO RESONATOR SWITCH

BACKGROUND OF THE INVENTION

1. Field of the Invention

The present invention relates to microstrip switching circuits, and particularly to a microstrip Fano resonator switch circuit having a varactor electrically connected between two symmetrical stubs disposed on a non-conductive substrate.

2. Description of the Related Art

The importance of control over wave propagation and antenna radiation are becoming apparent as the RF technologies advance and the spectrum gets more dense. With the current trend of multi-standard wireless mode integration, high-speed RF signal selectability has become a core issue.

To meet the needs of the modern communication systems, various technologies have been exploited that realize novel designs of microwave switches and filters. A microstrip-based tunable switch has been designed using a thin film barium-strontium-titanate varactor. To dynamically reconfigure the antenna pattern, a microelectromechanical systems (MEMS) switch has been exploited. For low loss applications, thermally pulsed chalcogenide phase change materials have been utilized. On the other hand, electro-optical tunability of THz waves has been realized by biasing of graphene metasurfaces. However, none of these devices have proven to be entirely satisfactory.

Thus, a microstrip Fano resonator switch solving the aforementioned problems is desired.

SUMMARY OF THE INVENTION

The microstrip Fano resonator, switch is a microstrip circuit having a varactor electrically connected between two identical quarter-wavelength open stubs formed from two elongate planar capacitive strip elements disposed on a substrate having a permittivity of approximately 2.94 and a thickness of approximately 0.76 mm, the circuit forming a Fano resonator switch that provides approximately 50 dB of isolation.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
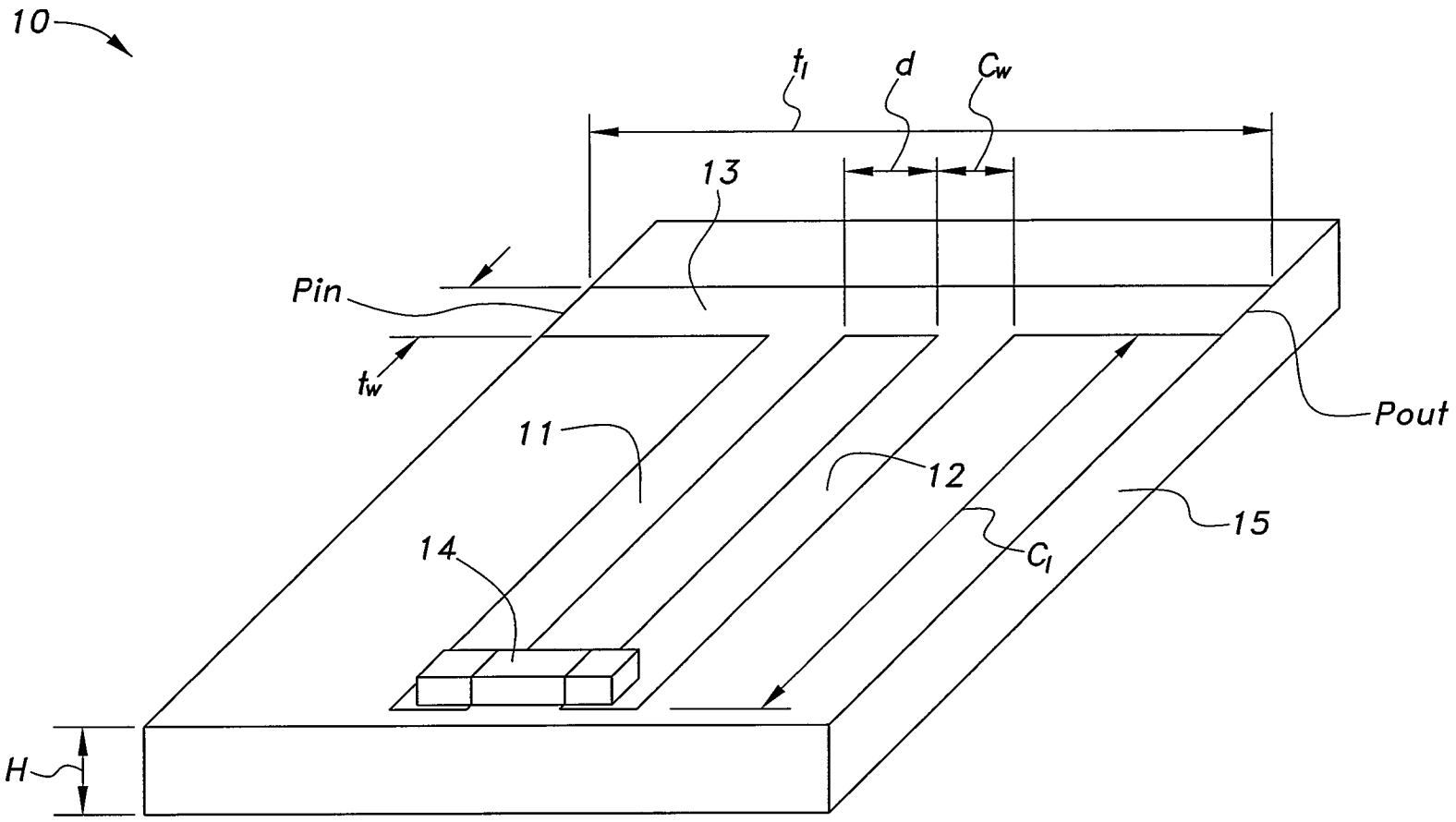
FIG. 1 is a perspective view of a microstrip Fano resonator switch according to the present invention.

Referring to FIG. 1, the microstrip Fano resonator switch 10 is a microstrip circuit having a varactor diode 14 electrically connected between two identical quarter-wavelength open stubs formed from two elongate planar electrically conducting strip elements 11, 12 extending perpendicularly into an electrically conducting transmission strip 13, the transmission strip 13 having an input side $P_{in}$ and an output side $P_{out}$, all strip elements being disposed on a non-conducting substrate 15 having a permittivity of approximately 2.94 and a thickness H of approximately 0.76 mm, the circuit forming a Fano resonator switch 10 that provides approximately 50 dB of isolation. The transmission strip 13 has an exemplary total length, $t_1$=20 mm, and an exemplary width, $t_w$=3.16 mm. The stubs 11 and 12 are of exemplary width $C_w$=2 mm. Stubs 11 and 12 have open ends, which are distal from the conducting transmission strip 13.

The Fano lineshape can be constructed analytically from the modulation of the background resonance with the Fano asymmetric function. The symmetric background resonance is described by:

$$R_b(\omega) = \frac{a^2}{\left(\frac{\omega^2 - \omega_s^2}{(\Delta\omega_s + \omega_s)^2 - \omega_s^2}\right)^2 + 1} \tag{1}$$

Here, parameters $\alpha$, $\omega_s$, $\Delta\omega_s$ are the maximum amplitude of the background resonance, resonance frequency position, and the resonance bandwidth, respectively. The modulating asymmetric Fano function $\sigma_a(\omega)$ can be expressed as:

$$\sigma_a(\omega) = \frac{\left(\frac{\omega^2 - \omega_a^2}{(\Delta\omega_a + \omega_a)^2 - \omega_a^2} + q\right)^2 + b}{\left(\frac{\omega^2 - \omega_a^2}{(\Delta\omega_a + \omega_a)^2 - \omega_a^2}\right)^2 + 1} \tag{2}$$

where the parameters $\omega_a$, $\Delta\omega_a$, q, and b represent the resonance frequency position, and the spectral bandwidth, asymmetry parameter, and loss due to intrinsic losses, respectively. The reflectance R is given by the product of $R_b$ and $\sigma_a$. Note that the asymmetric Fano function ($\sigma_a$) is a dark mode that could not exist independently. To obtain the bright resonance with the unique asymmetric line shape, it needs to be mixed together with the broadband background resonance.

Consider the coupled quarter-wavelength open-stub microstrip structure 10 in FIG. 1, which supports the Fano resonance. While a single open-circuited stub provides the required background resonance state, by having two identical open stubs, e.g., stub 11 and stub 12, each having exemplary length $C_l$=35 mm, in close proximity (separated by an exemplary distance d=2 mm) leads to the dual resonance states. The characteristic Fano resonance combination involves a strong mutual coupling between the two open-stubs that leads to slight detuning of the otherwise identical resonances. To observe the Fano resonance formation and the associated switching, the full-wave simulations with the finite element-based electromagnetic simulator COMSOL are performed. The perfect electric conductor (PEC) is used to model all the conducting planes, and the computational domain is terminated by scattering boundary conditions.

Figure 2:
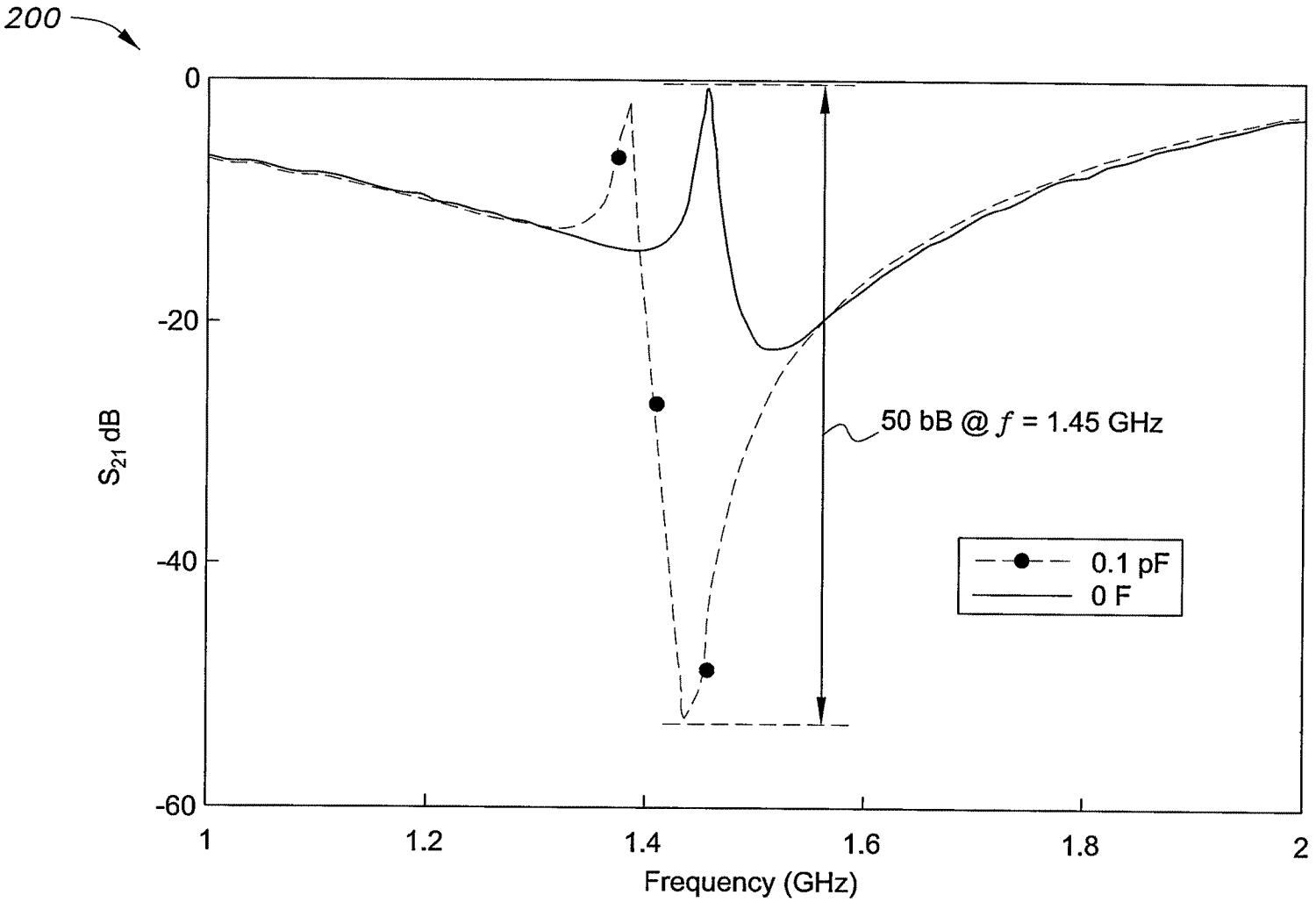
FIG. 2 is a plot illustrating the transmission coefficient of the microstrip Fano resonator switch of FIG. 1.

The simulated transmission responses of the present microstrip structure 10 are depicted as plot 200 in FIG. 2. It can be observed that with no capacitance inserted, the slight detuning of the resonances leads to a transparency window around 1.455 GHz. It should be emphasized here that with the two-stub geometry, a perfect interference between the resonant modes under ideal lossless condition is generated that leads to zero insertion loss in the transmission response. To demonstrate the 'Fano switching', the most intensive fields are perturbed by numerically positioning a 0.1 pF capacitor towards the end of the open stubs. Consequently, the transparency window is red-shifted (dotted line of plot 200) from 1.48 to 1.38 GHz. As a result, microwave switching of approximately 50 dB difference between 'on' and 'off' states is observed at the 1.48 GHz frequency. To explain the associated resonance formation, the stubs' electric field distributions in the presence of the 0.1 pF capacitor are considered at three different frequencies in the transparency window. At 1.37 GHz, the fields are out of phase, and hence destructively interfere to form the new resonance peak of the transparency window. Subsequently, it can be observed that at the intermediate frequency of 1.41 GHz, the phase reversal is observed on the two stubs. Close to the switching frequency of 1.45 GHz, the fields get in phase to interfere constructively, which leads to the suppression of transmission.

To obtain various Fano resonance parameters, the reflectance ($|R|^2$) obtained from equations (1) and (2) is fitted to the simulated extinction spectrum ($1-|S_{21}|^2$) using the non-linear Levenberg-Marquardt algorithm. The resulting parameters are summarized in Table 1. In particular, consider the 'q' parameter that describes the degree of asymmetry of the line shape and is the most relevant parameter in switching applications. The retrieved values exhibit an increase of 'q' from 0.1 to 0.135 as the capacitance is changed from 0 pF to 0.1 pF.

This increase in 'q' is necessary for the suppression of the transparency window.

TABLE 1

The Fitted Fano Line Shape Parameters

| | Capacitance | |
|---|---|---|
| Parameters | 0 pF | 0.1 pF |
| q | 0.10 | 0.135 |
| a, b | 0.97, 0.14 | 0.98, 0.37 |
| $\omega_s$ | 1.483 GHz | 1.469 GHz |
| $\Delta\omega_s$ | 0.581 GHz | 0.487 GHz |
| $\omega_\alpha$ | 1.456 GHz | 1.383 GHz |
| $\Delta\omega_\alpha$ | 0.005 GHz | 0.006 GHz |

Figure 3:
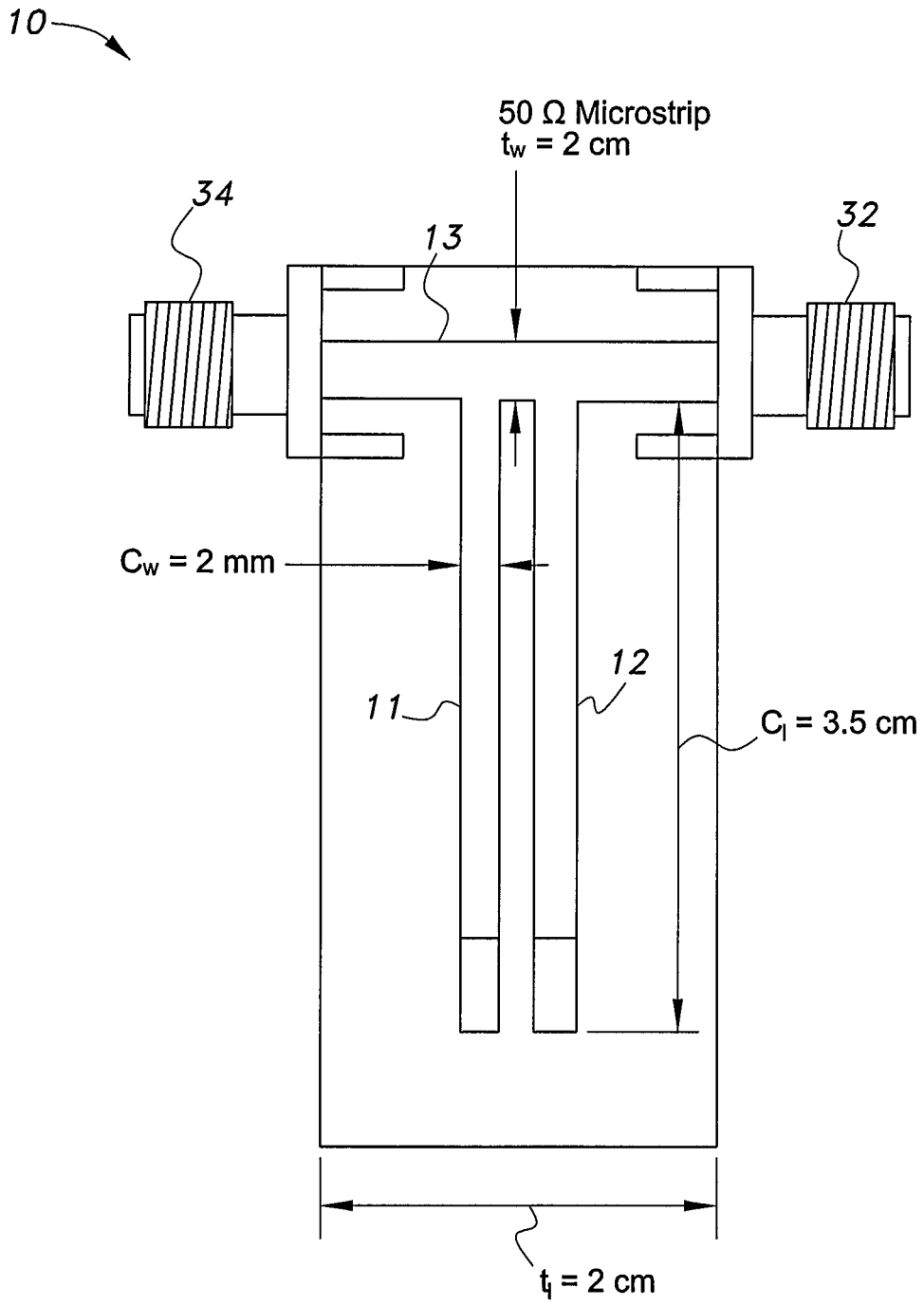
FIG. 3 is a top view of an exemplary microstrip Fano resonator switch according to the present invention.

FIG. 3 shows the microstrip circuit 10 without varactor diode 14. The transmission strip 13 is electrically connected to an input coaxial connector 34 and an output coaxial connector 32. For practical demonstration of the switching function, the microstrip circuit was fabricated on Rogers 6002 substrate using a MITS AUTOLAB milling machine. The microstrip circuit is characterized by a Rohde and Schwarz AVL13 Vector Network Analyzer. The experimental results are consistent with the results shown in plot 200 of FIG. 2. Two capacitances, each having a value of 0.4 pF, were connected in series to obtain an equivalent capacitance of 0.2 pF between the stubs. This amount of capacitance was enough to red shift the resonance state in order to achieve a switching contrast of 55 dB at 1.48 GHz. Although static capacitive elements were used in the experiment, it is emphasized that dynamic real-time 'Fano switching' can be realized by means of adding a varactor element, such as varactor diode 14 (shown in FIG. 1) between the two open stubs 11 and 12. The insertion loss of 3 dB is mainly due to the material losses and fabrication imperfections present in the experiment. The experiment conducted proves the concept of Fano switching in microstrip structures that can ideally have negligible transmission losses. The transmission coefficient can be drastically improved by utilizing low-loss materials, such as alumina or ceramic, and precision fabrication techniques that are currently used in hybrid circuits.

A simple yet powerful double-stub microstrip resonator circuit was designed to achieve asymmetric Fano lineshape resonance at microwave frequencies. It was demonstrated experimentally that a slight tuning by placing a 0.2 pF capacitor between the open-stub ends can lead to an approximately 50 dB difference between the on-off states of the Fano resonance. The associated Fano asymmetry parameter q was analytically calculated. It was demonstrated that the resulting q guaranteed a close proximity of the resonant peak and dip with high contrast, thereby helping to switch the transparency window. It was experimentally established that such a tunable Fano resonator is suitable for real time switching and filtering applications. The present microstrip Fano resonator switch should prove useful in transceiver designs having a T/R (Transmit/Reflect) switch, in TDM systems in MIMO and phase array radars, and in numerous other switching and filter applications.

It is to be understood that the present invention is not limited to the embodiments described above, but encompasses any and all embodiments within the scope of the following claims.

We claim:

1. A microstrip Fano resonator switch, comprising:

a non-conducting substrate;

a rectangular conducting transmission strip disposed on the non-conducting substrate;

first and second substantially identically dimensioned rectangular conducting stubs disposed on the non-conducting substrate in parallel relation and in close proximity to each other and in perpendicular relation to the conducting transmission strip, the stubs being electrically connected to and extending from the transmission strip, the stubs having open ends distal from the conducting transmission strip; and a capacitance disposed proximate the stub open ends and electrically connected to the stub open ends;

wherein, the transmission strip and the capacitive open stubs in close proximity to each other form a Fano resonator having a switching frequency that induces in-phase electromagnetic fields which interfere constructively to suppress transmission via the transmission strip at the switching frequency.

2. The microstrip Fano resonator switch according to claim 1, wherein the switch has a modulating asymmetric Fano function $\sigma_a(\omega)$ characterized by:

$$\sigma_a(\omega) = \frac{\left(\frac{\omega^2-\omega_a^2}{(\Delta\omega_a+\omega_a)^2-\omega_a^2}+q\right)^2+b}{\left(\frac{\omega^2-\omega_a^2}{(\Delta\omega_a+\omega_a)^2-\omega_a^2}\right)^2+1},$$

where $\omega_a$, $\Delta\omega_a$, q, and b are parameters representing a resonance frequency position, a spectral bandwidth, an asymmetry parameter, and a loss due to intrinsic losses, respectively.

3. The microstrip Fano resonator switch according to claim 1, wherein the capacitance is a varactor diode having a variable capacitance tuning the frequency response of the Fano resonator switch.

4. The microstrip Fano resonator switch according to claim 3, wherein the switching frequency is 1.48 GHz, so that a change of 0.1 pF in the variable capacitance of the varactor diode results in 50 dB isolation between 'on' and 'off' states of the Fano resonator switch.

5. The microstrip Fano resonator switch according to claim 1, wherein the substrate has a permittivity of approximately 2.94.

6. The microstrip Fano resonator switch according to claim 1, wherein the substrate has a thickness of approximately 0.76 mm.

7. The microstrip Fano resonator switch according to claim 1, wherein the switch has a symmetric background resonance characterized by:

$$R_b(\omega) = \frac{a^2}{\left(\frac{\omega^2 - \omega_s^2}{(\Delta\omega_s + \omega_s)^2 - \omega_s^2}\right)^2 + 1},$$

where $\alpha$, $\omega_s$, $\Delta\omega_s$ are parameters representing a maximum amplitude of the background resonance, a resonance frequency position, and a resonance bandwidth, respectively.

8. The microstrip Fano resonator switch according to claim 1, wherein the stubs have a length that is a quarter wavelength of the switching frequency.

9. The microstrip Fano resonator switch according to claim 8, wherein each said stub has a length of approximately 35 mm.

10. The microstrip Fano resonator switch according to claim 9, wherein the stubs are separated from each other by a distance d of approximately 2 mm.

11. The microstrip Fano resonator switch according to claim 10, wherein each of the stubs has a width of approximately 2 mm.

12. The microstrip Fano resonator switch according to claim 10, wherein the transmission strip has a total length of approximately 20 mm.

13. The microstrip Fano resonator switch according to claim 12, wherein the transmission strip has a width of approximately 3.16 mm.

* * * * *